United States Patent [19]

Smith

[11] Patent Number: 4,836,090

[45] Date of Patent: Jun. 6, 1989

[54] BALANCED VARIABLE STROKE AXIAL PISTON MACHINE

[75] Inventor: Richard H. Smith, Birmingham, Mich.

[73] Assignee: General Motors Corporation, Detroit, Mich.

[21] Appl. No.: 206,070

[22] Filed: Jun. 13, 1988

Related U.S. Application Data

[63] Continuation-in-part of Ser. No. 148,850, Jan. 27, 1988.

[51] Int. Cl.[4] ..... F04B 1/26

[52] U.S. Cl. ..... 92/12.2; 417/222 S; 417/269

[58] Field of Search ..... 92/12.2; 74/60; 417/264, 222 S

[56] References Cited

U.S. PATENT DOCUMENTS

| | | | |
|---|---|---|---|
| 2,706,384 | 4/1955 | Schott | 74/60 |
| 2,964,234 | 12/1960 | Loomis | 74/60 |
| 3,292,554 | 12/1966 | Hessler | 417/269 |
| 4,077,269 | 3/1978 | Hodgkinson | 417/269 |
| 4,372,116 | 2/1983 | Dineen | 74/60 |
| 4,428,718 | 1/1984 | Skinner | 417/222 |
| 4,480,964 | 11/1984 | Skinner | 417/222 |

FOREIGN PATENT DOCUMENTS

| | | | |
|---|---|---|---|
| 610593 | 12/1960 | Canada | 417/269 |
| 2524148 | 1/1976 | Fed. Rep. of Germany | 417/269 |

*Primary Examiner*—William L. Freeh
*Attorney, Agent, or Firm*—R. L. Phillips

[57] ABSTRACT

A variable stroke axial piston machine having a balance disk that conjointly tilts and is driven with a swash plate to balance a rotating couple induced by the pistons.

2 Claims, 4 Drawing Sheets

BALANCED VARIABLE STROKE AXIAL PISTON MACHINE

TECHNICAL FIELD

This invention relates to axial piston machines employing a variable angle swash plate mechanism and more particularly to the balancing of a rotating couple acting on such mechanism.

BACKGROUND OF THE INVENTION

In variable stroke axial piston machines employing a variable angle swash plate mechanism such as the automotive refrigerant compressor disclosed in U.S. Pat. 4,428,718, the reciprocating pistons induce a rotating couple on the swash plate. And if the stroke is variable as it is in the afore-mentioned refrigerant compressor, the magnitude of this couple changes with the stroke change. In such a mechanism, there is also a socket plate which by its wobbling adds to the rotating couple caused by the pistons. In arrangements such as the above-noted compressor, the location of the swash plate tilt axis is determined by mechanical considerations and it is not reasonably possible to provide counterweights sufficient to move the swash plate's mass centroid to its tilt axis for balancing as the added masses would interfere with the working mechanism. And if mass was added to the swash plate to balance the rotating couple and static unbalance at one swash plate angle, this would move the mass centroid further from the tilt axis and thereby increase the static unbalance at all other swash plate angles.

SUMMARY OF THE INVENTION

The present invention solves the problem by providing an auxiliary balance disk that tilts conjointly with the swash plate to maintain static balance. The auxiliary balance disk is preferably made dynamically identical to the swash plate, i.e., the mass and the distance from the center of gravity to the tilt axis are the same for both the swash plate and the balance disk. However, the balance disk is mounted such that at zero displacement (stroke), the centers of gravity of both the swash plate and the balance disk are between their respective tilt axis. However, it will also be appreciated that both tilt axes could also be between the two centers of gravity. Then as long as the balance disk and the swash plate tilt at the same angle, the static balance is retained. And equal masses can be added or subtracted from the swash plate and the balance disk to balance the rotating couple.

Preferably, the balance disk is mounted with a fixed pivot point like the swash plate on a sleeve that is slidably mounted on and driven by a drive shaft and the correct tilt of the balance disk is provided in one embodiment by using contacting cam surfaces on opposing faces of the swash plate and balance disk. The sum of the two contacting cam radii equal the distance between the two fixed pivot points and therefore the swash plate and the balance disk are forced to behave as if they were connected by parallelogram linkage and remain parallel. Preferably, the cams can be of full surface or could also be only localized spots formed on the respective members. In another embodiment, the balance disk is mounted for relative axial movement as well as tilting and rotary movement with the swash plate. And the balance disk and swash plate are then formed with flat faces which are caused to remain in contact with a spring to maintain the desired parallelism of these parts.

DETAILED DESCRIPTION OF PREFERRED EMBODIMENT

These and other objects, advantages and features of the present invention will become more apparent from the following detailed description and drawing in which.

Figure 1:
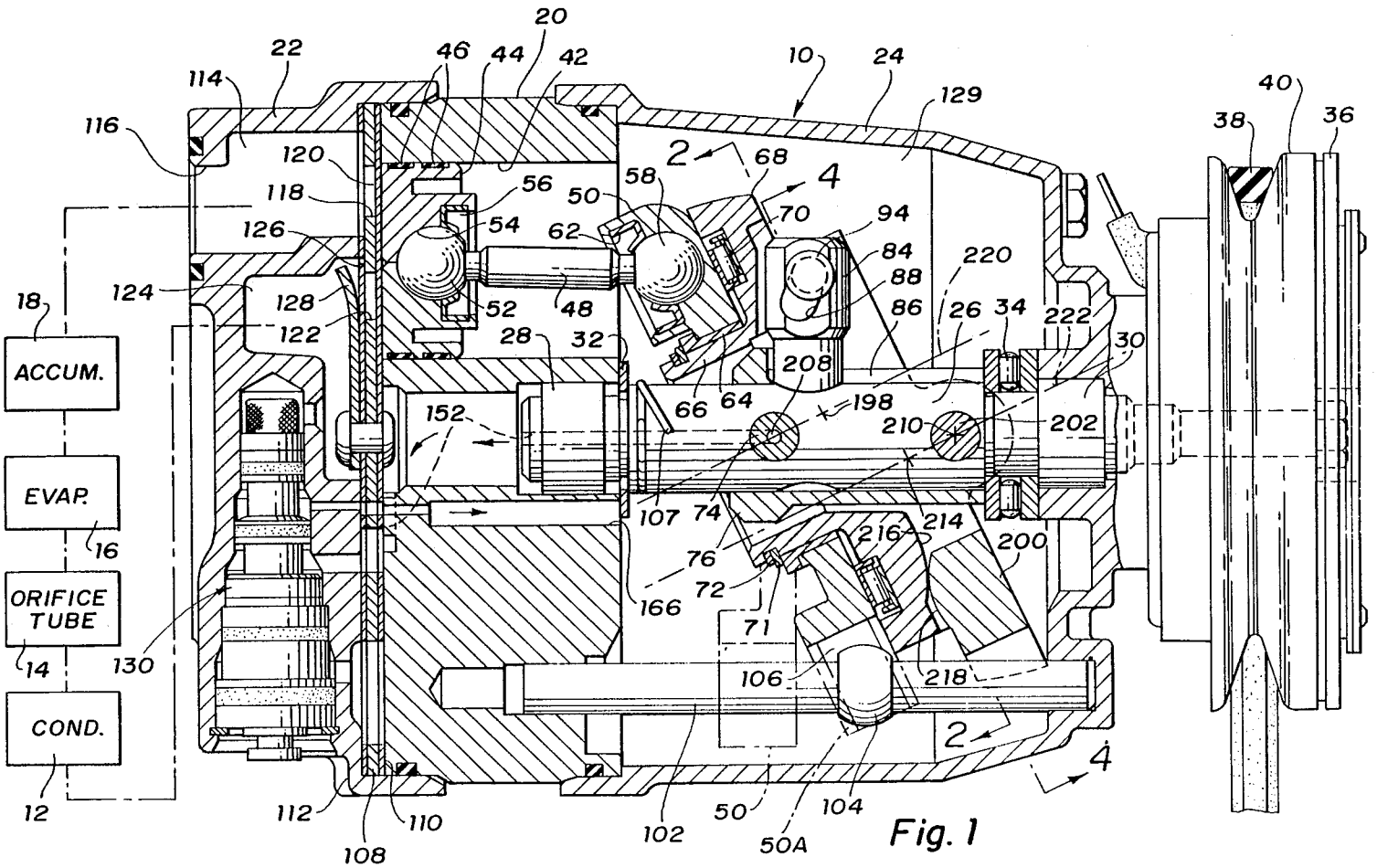
FIG. 1 is a longitudinal sectional view of a variable displacement refrigerant compressor of the variable angle swash plate type having incorporated therein the preferred embodiment of the balancing arrangement according to the present invention. This figure further includes a schematic of an automotive air conditioning system in which the compressor is connected.

Referring to FIG. 1, there is shown a variable displacement refrigerant compressor 10 of the variable angle swash plate type connected in an automotive air conditioning system having the normal condenser 12, orifice tube 14, evaporator 16 and accumulator 18 arranged in that order between the compressor's discharge and suction side.

The compressor 10 comprises a cylinder block 20 having a head 22 and a crankcase 24 sealingly clamped to opposite ends thereof. A drive shaft 26 is supported centrally in the compressor at the cylinder block 20 and crankcase 24 by needle bearings 28 and 30, respectively, and is axially retained by a thrust washer 32 inward of the needle bearing 28 and a needle bearing 34 inward of the needle bearing 30. The drive shaft 26 extends through the crankcase 24 for connection to an automotive engine (not shown) by an electromagnetic clutch 36 that is mounted on the crankcase and is driven from the engine by a belt 38 engaging a pulley 40 on the clutch.

The cylinder block 20 has five axial cylinders 42 extending therethrough (only one being shown) which are angularly spaced about and equally radially spaced from the axis of the drive shaft. The cylinders 42 extend parallel to the drive shaft and a piston 44 having seals 46 is mounted for reciprocal sliding movement in each of the cylinders. A separate piston rod 48 connects the backside of each piston 44 to a non-rotary ring-shaped wobble plate 50 (also called a socket plate) received about the drive shaft. Each of the piston rods 48 is connected to its respective piston 44 by a spherical rod end 52 which is retained in a socket 54 on the backside of the piston by a retainer 56 that is swaged in place. The opposite end of each piston rod 48 is connected to the wobble plate 50 by a similar spherical rod end 58 which is retained in a socket 60 on the socket plate by a split retainer ring 62 which has a snap fit with this plate.

The non-rotary socket plate 50 is mounted at its inner diameter 64 on a journal 66 of a rotary swash plate 68 (also called a drive plate) and is axially retained thereon against a needle bearing 70. The swash plate 68 is pivotally connected at its journal 66 by a pair of pivot pins 74 to a sleeve 76 that is slidably mounted on the drive shaft 26, the pins being mounted in aligned bores 78 and 80 (see FIG. 2) in opposite sides of the journal 66 and radially outwardly extending bosses (not shown) on the sleeve 76 with the common axis of the pivot pins intersecting at right angles with the axis of the drive shaft 16 to permit angulation of the swash plate 68 and wobble plate 50 relative to the drive shaft.

The drive shaft 26 is drivingly connected to the swash plate 68 by a lug 84 that extends freely through a longitudinal slot 86 in the sleeve 76. The drive lug 84 is threadably connected at one end to the drive shaft 26 at right angles thereto and extends radially outward past the journal 66 where it is provided with a guide slot 88 for guiding the angulation of the swash plate 68 and wobble plate 50. The drive lug 84 has flat-sided engagement on one side thereof at 90 with an ear 92 formed integral with the drive plate 68 and is retained thereagainst by a cross pin 94 which is at right angles to the drive shaft and is slidable in and guided by the guide slot 88 as the sleeve 76 moves along the drive shaft 26 (see FIGS. 1 and 2). The cross pin 94 is retained in place on the swash plate 68 at its ear 92 by being provided with an enlarged head 96 at one end which engages the lug at one side of the slot 88 and being received adjacent the other end in a cross hole 98 in the drive plate ear 92 where it is retained by a snap ring 100 (see FIGS. 2 and 3). The wobble plate 50 while being angularable with the rotary swash plate 68 is prevented from rotating therewith by a guide pin 102 on which a ball guide 104 is slidably mounted and retained on the wobble plate (see FIG. 1). The guide pin 102 is fitted at opposite ends in the cylinder block 20 and crankcase 24 parallel to the drive shaft 26 and the ball guide 104 is retained between semi-cylindrical guide shoes 106 (only one being shown) which are slidably mounted for reciprocal radial movement in an arm 50A extending from the wobble plate 50.

Figure 2:
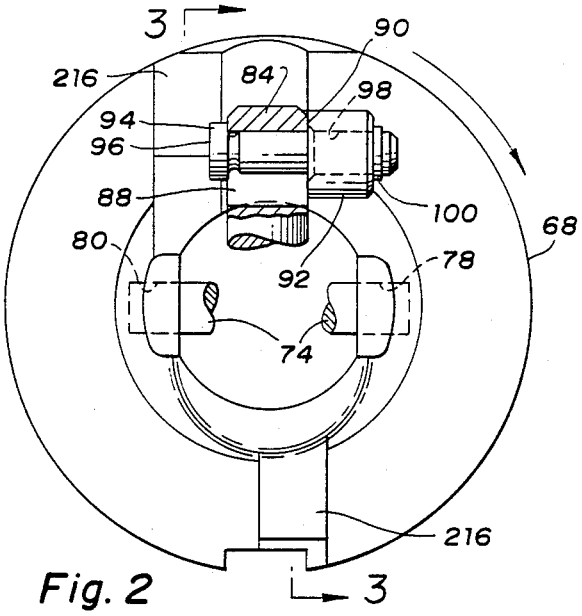
FIG. 2 is an end view of the swash plate looking in the direction of the arrows 2—2 in FIG. 1.
Figure 3:
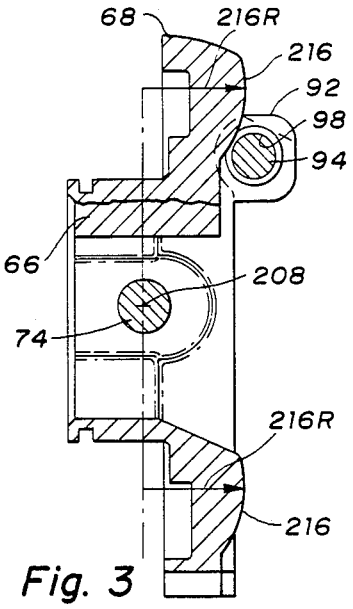
FIG. 3 is a sectional view of the swash plate taken along the line 3—3 in FIG. 2.
Figure 4:
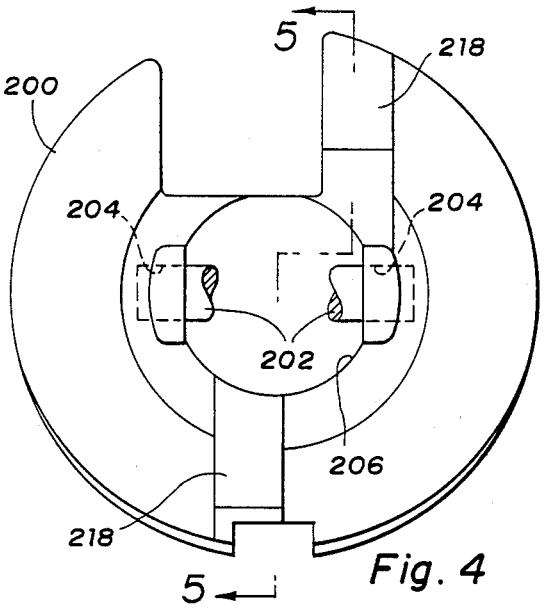
FIG. 4 is an end view of the balance disk looking in the direction of the arrows 4—4 in FIG. 1.
Figure 5:
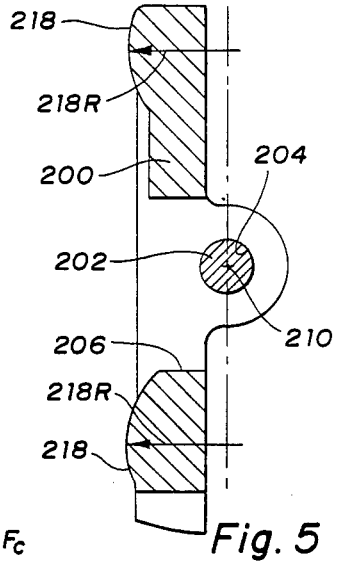
FIG. 5 is an enlarged partial sectional view of the balance disk taken along the lines 5—5 in FIG. 4.

Essentially constant top-dead-center positions for each of the pistons 44 is provided by the pin follower 94 which is movable radially with respect to the drive lug 84 along its guide slot or cam track 88 as the sleeve 76 moves along the drive shaft 26 while the latter is driving the swash plate 68 through the drive lug 84 and drive plate ear 92 in the direction indicated by the arrow in FIG. 2. As a result, the angle of the wobble plate 50 is varied with respect to the axis of the drive shaft 26 between the solid line large angle position shown in FIG. 1 which is full stroke to the zero angle phantom-line position shown which is zero stroke to thereby infinitely vary the stroke of the pistons and thus the displacement or capacity of the compressor between these extremes. As shown in FIG. 1, there is provided a split ring return spring 107 which is mounted in a groove on the drive shaft 26 and has one end that is engaged by the sleeve 76 during movement to the zero wobble angle position and is thereby conditioned to initiate return movement.

The working ends of the cylinders 42 are covered by a valve plate 108 which together with an intake or suction valve disk 110 and an exhaust or discharge valve disk 112 located on opposite sides thereof are clamped to the cylinder block 20 between the latter and the head 22. The head 22 is provided with a suction cavity or chamber 114 which is connected through an external port 116 to receive gaseous refrigerant from the accumulator 18 downstream of the evaporator 16. The suction cavity 114 is open to an intake port 118 in the valve plate 108 at the working end of each of the cylinders 42 where the refrigerant is admitted to the respective cylinders on their suction stroke each through a reed valve 120 formed integral with the suction valve disk 110 at these locations. Then on the compression stroke, a discharge port 122 open to the working end of each cylinder 42 allows the compressed refrigerant to be discharged into a discharge cavity or chamber 124 in the head 22 by a discharge reed valve 126 which is formed integral with the discharge valve disk 112 at these locations, the extent of opening of each of the discharge reed vales being limited by a rigid back-up strap 128 that is riveted at one end to the valve plate 108. The compressor's discharge cavity 124 is connected to deliver the compressed gaseous refrigerant to the condenser 12 from whence it is delivered through the orifice tube 14 back to the evaporator 16 to complete the refrigerant circuit as shown in FIG. 1.

The swash plate (wobble plate) angle and thus compressor displacement is controlled by controlling the refrigerant gas pressure in the sealed interior 129 of the crankcase behind the piston 44 relative to the suction pressure. In this type of control, the angle of the swash plate is determined by a force balance on the pistons wherein a slight elevation of the crankcase-suction pressure differential above a set suction pressure control point creates a net force on the pistons that results in a turning moment about the swash plate pivot pins 74 that acts to reduce the swash plate angle and thereby reduce the compressor capacity. This control is provided by a control valve 130 that is biased by both compressor suction pressure and discharge pressure and automatically operates in response thereto to connect the crankcase with either the suction cavity 114 via passage 152 or discharge cavity 124 via passage 166 (see flow arrows). The valve 130 operates when the air conditioning capacity demand is high and the resulting suction pressure rises above the control point so as to maintain a bleed or vent from the crankcase to suction so that there is no crankcase-suction pressure differential. As a result, the swash plate and wobble plate will then angle to their full stroke large angle position shown in FIG. 1 establishing maximum displacement. On the other hand, when the air conditioning capacity demand is lowered and the suction pressure falls to the control point, the control valve with its suction pressure bias then operates to close off the crankcase vent connection with suction and either provide communication between the compressor discharge and the crankcase or allow the pressure therein to increase as a result of gas blow-by past the pistons. This has the effect of increasing the crankcase-suction pressure differential which on slight elevation creates a net force on the pistons that results in a turning moment about the swash plate pivot pins 74 that reduces the swash plate and wobble plate angle and thereby reduces the compressor displacement. The discharge pressure bias opposes the suction pressure bias and has the effect of depressing the displacement change control point with increasing discharge pressure (higher ambients) to improve performance.

The axial piston machine thus far described is like that disclosed in the afore-mentioned U.S. Pat. No. 4,480,964 which is hereby incorporated by reference and to which reference is made for further in depth understanding of the above and other related structural details and operation. The preferred embodiments of the present invention are incorporated in the above machine and to help understand its contribution it is important to understand the unbalanced forces that normally exist in such a machine.

Figure 6:
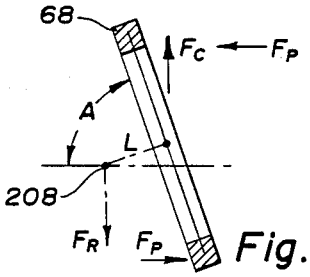
FIG. 6 is a schematic view of the swash plate with the forces acting thereon.

In the axial piston machine thus far described, the reciprocating pistons induce an unbalanced rotating couple acting on the swash plate as shown in FIG. 6 with $F_p$ representing the forces that induce the rotating couple. An exact equation for the rotating couple induced by this piston motion is complicated. However, if harmonic piston motion is assumed, the rotating couple equation (for three or more pistons) is as follows:

Torque=(total mass of pistons)×(radians/second)$^2$×(Cosine of the swash plate angle)×(radius)$^2$ all divided by 2

(where: 90° is greater than the swash plate angle is greater than approximately 60°

The wobbling wobble plate adds to the rotating couple caused by the reciprocating pistons. The equation for the rotating couple added by the wobble plate is as follows:

Torque=(polar moment of inertia)×(radians/second$^2$)×(Cosine of the swash plate angle)×(Sine of the swash plate angle)

where: the polar moment inertia=mass×radius$^2$ /2.

In the axial piston machine shown, the swash plate has insufficient mass to balance the rotating couple generated by the reciprocating pistons and its mass centroid is at 198. And adding additional rotating mass below the pivot center of the swash plate is not possible because its support structure would have to pass the indexing arm 50A of the nonrotating wobble plate. And even if the indexing of the wobble plate could be accomplished by some alternate means, the added mass would normally interfere with the crankcase. On the other hand, adding additional mass above the pivot point will move the mass centroid further from the pivot point and cause greater static imbalance when the swash plate angle is changed.

The present invention employs a rotating auxiliary balance or counterweight disk 200 to balance the piston induced and wobble plate supplemental rotating coupler and to also statically balance the mechanism. The balance disk 200 is centrally received on the drive shaft 26 on the side of the swash plate 68 opposite the wobble plate 50 and in the embodiment shown in FIGS. 1-5 and 8 is both pivotally and drivingly connected to the reciprocal drive sleeve 76 by a pair of pivot pins 202 (see FIGS. 1, 4 and 5). The pins 202 are received in diametrically opposite transverse bores 204 in a central opening 206 of the balance disk which receives this sleeve and the drive shaft extending therethrough and are connected at their inner ends to the sleeve 76 like the pivot pins for the swash plate previously described. Thus both the balance disk and the drive plate have their respective pivot centers 208 and 210 intersecting the drive shaft axis and on the sleeve which slides axially on such drive shaft. The balance disk is made dynamically identical to the swash plate with its mass centroid located at 214, i.e. the mass and the distance from the center of gravity to the tilt axis is the same for both the swash plate and the auxiliary disk. However, the balance disk is mounted such that at zero displacement, the centers of gravity 198 and 214 of the swash plate and the balance disk are between the two tilt axes and on the drive shaft axis (see FIG. 8). Then, if the balance disk and swash plate are caused to tilt at the same angle, the static balance will be retained.

In the embodiment in FIGS. 1-5 and 8, the swash plate and balance disk are made to tilt in conjunction with each other by each being formed with contacting pairs of cam surfaces 216 and 218 located on opposite sides of their tilt axes. The sum of the two contacting radii 216R and 218R equal the distance between the two pivots and therefore the swash plate and balance disk are forced to behave as if they were connected by a parallelogram 4-bar linkage and remain parallel as the swash plate is caused to tilt (i.e. the planes 220 and 222 passing through the pivot point and mass centroid of the respective swash plate and balance disk are caused to remain parallel as shown in FIG. 1). With the balance disk and swash plate caused to tilt at the same angle the static balance is retained throughout the range of swash plate tile. It will also be appreciated that equal masses can be added or subtracted from the swash plate and balance disk to exactly balance the rotating couple. To help understand these dynamics, the equation for the balancing couple from a rotating counterweight disk is as follows:

Torque=(polar moment of inertia)×(radians/second)$^2$×(Cosine of the swash angle)×(Sine of the swash angle) all divided by 2.

And the equation for the force resulting when a rotating disk is tilted about an axis displaced from its center of gravity is:

Force=(mass)×(distance from cg to tilt axis)×(Sine of the tilt angle) ×(radians/second)$^2$ where: Sine of the tilt angle=Cosine of the swash plate angle.

Figure 7:
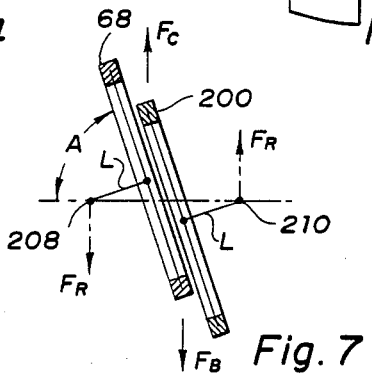
FIG. 7 is a schematic view of both the swash plate and the balance disk with the forces acting thereon.
Figure 8:
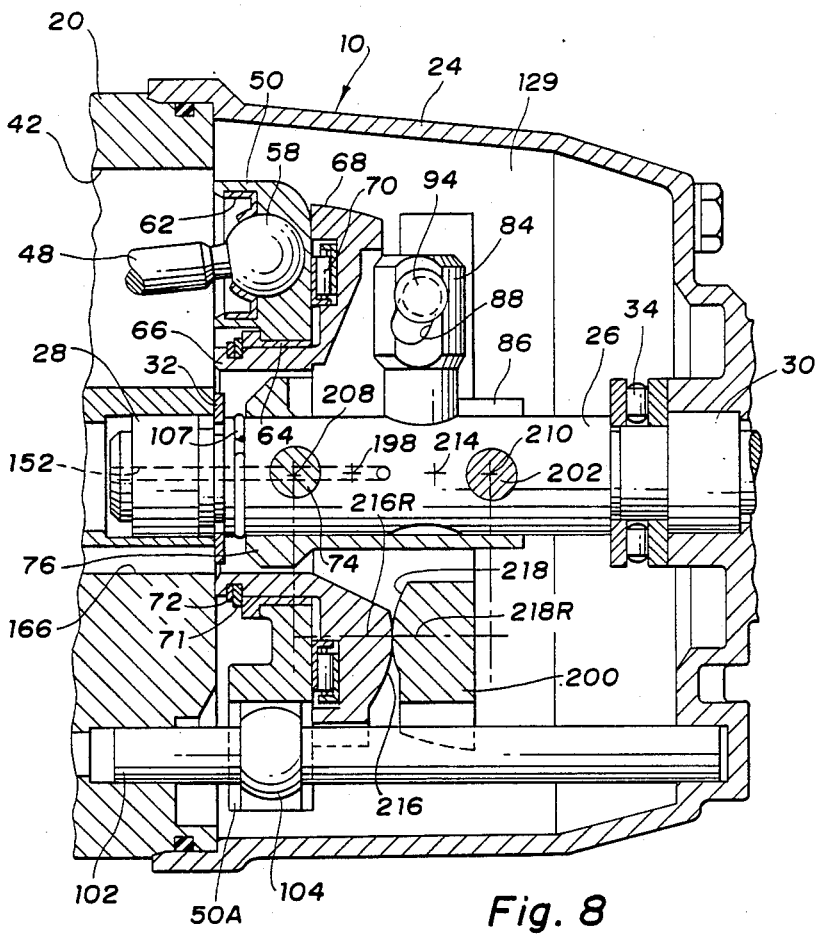
FIG. 8 is a partial view from FIG. 1 with the swash plate and balance disk at minimum displacement.

This force $F_c$ at a swash plate angle A as shown in FIG. 6 cannot be balanced by a fixed counterweight except for a singular swash plate angle because the force changes with the angle. The force $F_c$ creates an unbalanced reaction force $F_R$ at the pivot and also an unbalanced rotating couple with a moment arm L sin A. The balance disk of the present invention solves the problem by dividing the force into two equal and opposite forces which cancel each other as depicted in FIG. 7 with $F_C$ representing the induced force, $F_B$ the balancing force from the balance disk which is made equal to $F_C$ and $F_R$ their respective reaction force at their pivot point. Furthermore, it will be appreciated that the cams are illustrated as being a full surface but they may also be only localized spots to maintain the required contact through the range of angular movement.

Figure 9:
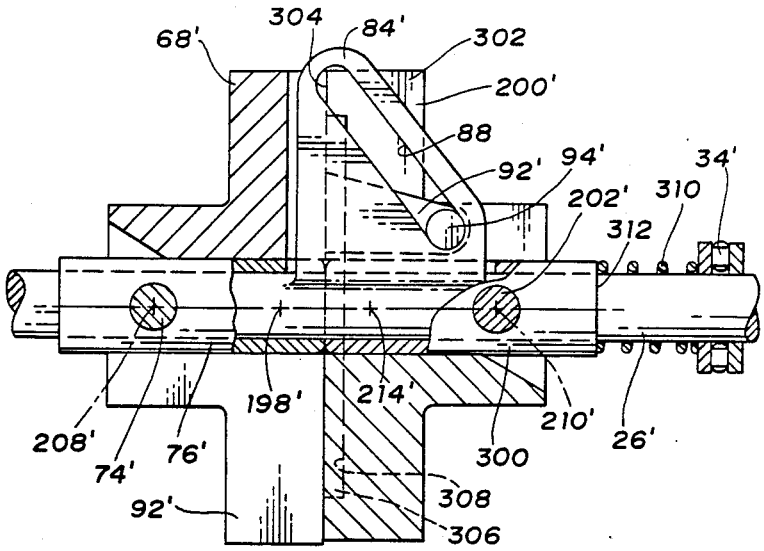
FIG. 9 is a schematic view of another embodiment of the swash plate and balance disk arrangement according to the present invention at minimum displacement.
Figure 10:
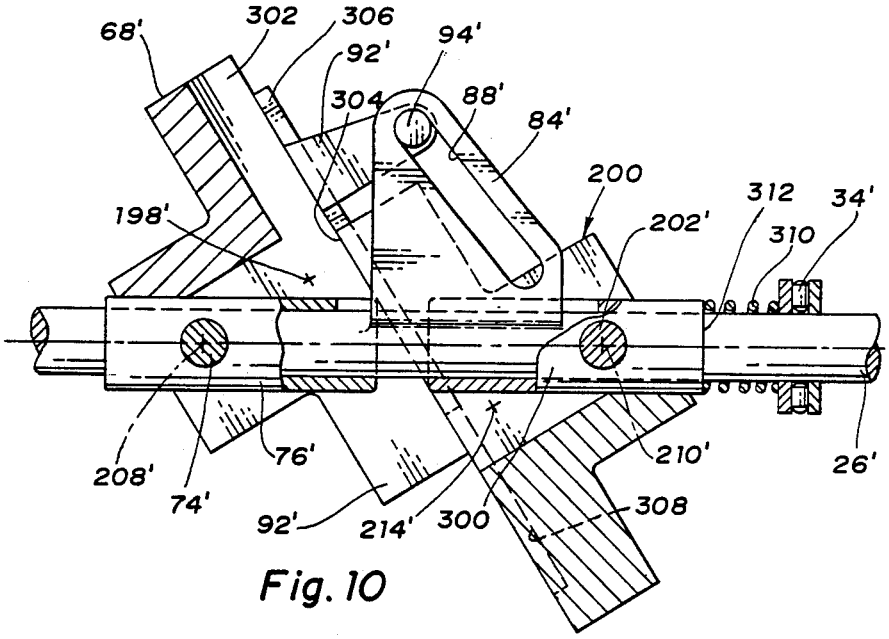
FIG. 10 is a view similar to FIG. 9 but with the swash plate and balance disk at maximum displacement.

Another device other than cams or some form of 4-bar linkage for maintaining the auxiliary disk parallel to the swash plate is shown in FIGS. 9 and 10. In this embodiment, those parts similar to or like those previously described are identified by the same numbers only primed and significantly different parts are identified by new numbers. In this embodiment, the swash plate 68' with its mass centoid 198' is pivotally mounted on a reciprocal sleeve 76' and driven by the shaft 26' through an ear 92' as before, such drive being through a lug 84' which is fixed to the shaft and has side rotary drive contact with the ear 92' (but not the sleeve 76') and an arcuate slot 88' and pin 94'connection with this ear. In this embodiment, the balance disk 200' with its mass centoid 214' is not on the same sleeve as the swash plate and instead is pivotally mounted with its pins 202' on a separate sleeve 300 slidably mounted on the shaft 26'.

The swash plate 68' and balance disk 200' are formed with opposing flat faces 302 and 304 respectively at right angles to their center axis (which coincides with the shaft axis at zero angle) and the balance disk is caused to be driven with the swash plate by a straight tongue 306 on the latter that is slidably received in a groove 308 on the former and at right angles to the swash plate tilt axis. A compression coil spring 310 mounted about the shaft between the outer end 312 of the balance disk sleeve and the inner side of the thrust bearing 34'' pushes the balance disk against the swash plate so that their flat faces 302 and 304 are caused to remain in contact. This spring force maintains the tongue and groove drive connection between the swash plate 68' and balance disk 200' as well as holds these parts parallel by such face contact as they are caused to tilt from the minimum tilt angle depicted in FIG. 9 to the maximum angle depicted in FIG. 1—with the balance disk 200'providing balance as previously described.

In the particular 5-cylinder arrangement, the force of the added spring 310 will tend to urge the drive mechanism to minimum stroke (displacement) and thereby require a greater actuation force to maintain or increase the stroke. This is simply accomplished by correspondingly reducing the crankcase pressure.

The foregoing description of the preferred embodiments of the invention have been presented for purposes of illustration and description. It is not intended to be exhaustive or to limit the invention to the precise form disclosed. Obvious modifications or variations are possible in light of the above teaching. The embodiment was chosen and described to provide the best illustration of the principles of the invention and its practical application to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally and equitably entitled.

The embodiments of the invention in which an exclusive property or privilege is claimed are defined as follows:

1. A variable stroke axial piston machine having a shaft, a swash plate centrally received on said shaft, means operatively connecting said swash plate to said shaft for rotation therewith and relative axial movement and tilting relative thereto about an axis at right angles to and intersecting with the axis of said shaft, a wobble plate centrally received on said shaft and operatively contacting one side of said swash plate, means preventing said wobble plate from rotating so that said wobble plate is caused to rotate by operative contact with said one side of said swash plate on shaft rotation through an angle determined by that of said swash plate, a plurality of pistons spaced about and axially movable relative to said shaft, a connecting rod connecting each said piston to said wobble plate, characterized by a balance disk centrally received on said shaft opposite the other side of said swash plate, means mounting said balance disk on said shaft for relative axial movement and tilting relative thereto about an axis at right angles to and intersecting with the axis of said shaft at a point spaced from that of said swash plate, contacting flat faces on said swash plate and balance disk for causing planes passing through the tilt axis and mass centroid of the respective balance disk and balance disk to be and remain parallel, drive means for drivingly connecting said balance disk to said swash at said faces for rotation therewith, and spring means for causing said flat faces to remain in contact.

2. A variable stroke axial piston machine having a shaft, a swash plate centrally received on said shaft, means operatively connecting said swash plate to said shaft for rotation therewith and relative axial movement and tilting relative thereto about an axis at right angles to and intersecting with the axis of said shaft, a wobble plate centrally received on said shaft and operatively contacting one side of said swash plate, means preventing said wobble plate from rotating so that said wobble plate is caused to rotate by operative contact with said one side of said swash plate on shaft rotation through an angle determined by that of said swash plate, a plurality of pistons spaced about and axially movable relative to said shaft, a connecting rod connecting each said piston to said wobble plate, characterized by a balance disk centrally received on said shaft opposite the other side of said drive plate, means mounting said balance disk on said shaft for relative axial movement and tilting relative thereto about an axis at right angles to and intersecting with the axis of said shaft at a point spaced from that of said drive plate, contacting flat faces on said swash plate and balance disk located on opposite sides of their respective tilt axis for causing planes passing through the tilt axis and mass centroid of the respective balance disk and balance disk to be and remain parallel, a tongue projecting from one of said flat faces engaged in a groove in the other face for drivingly connecting said balance plate to rotate with said swash plate, and a compression coil spring mounted about said shaft for causing said flat faces and said tongue and groove to remain in contact and driving engagement respectively.

* * * * *